US008187042B2

(12) United States Patent
Kimura

(10) Patent No.: US 8,187,042 B2
(45) Date of Patent: May 29, 2012

(54) WATERPROOF CONNECTOR THAT CAN BE DESIGNED TO BE SHORT IN OVERALL LENGTH

(75) Inventor: Akinori Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/931,430

(22) Filed: Feb. 1, 2011

(65) Prior Publication Data

US 2011/0217859 A1 Sep. 8, 2011

(30) Foreign Application Priority Data

Mar. 5, 2010 (JP) ..... 2010-048809

(51) Int. Cl.
*H01R 13/514* (2006.01)

(52) U.S. Cl. ..... 439/752; 439/271

(58) Field of Classification Search ..... 439/752, 439/595, 271

See application file for complete search history.

(56) References Cited

U.S. PATENT DOCUMENTS 4,944,688 A * 7/1990 Lundergan ..... 439/275
5,593,326 A * 1/1997 Listing ..... 439/752
6,045,404 A * 4/2000 Myer ..... 439/595
6,155,888 A 12/2000 Kurimoto
6,200,164 B1 * 3/2001 Martin et al. ..... 439/595
6,409,552 B2 * 6/2002 Matsumoto ..... 439/752
6,568,948 B2 * 5/2003 Matsuoka ..... 439/271
6,786,768 B2 * 9/2004 Murakami ..... 439/595
6,805,592 B2 * 10/2004 Kurimoto ..... 439/752
7,488,221 B2 * 2/2009 Tanaka et al. ..... 439/752

FOREIGN PATENT DOCUMENTS

JP 2000-173709 6/2000

* cited by examiner

*Primary Examiner* — Gary F. Paumen
(74) *Attorney, Agent, or Firm* — Collard & Roe, P.C.

(57) ABSTRACT

A retainer is incorporated into a fitting portion of a housing so as to be movable between a preset position and a set position in a direction crossing terminal receiving holes. Further, a seal member is attached to an outer periphery of the fitting portion. The seal member is brought into close contact with an inner periphery of a fitting hole of a mating connector for sealing when the fitting portion is fitted to the fitting hole. The retainer has projections which retreat to the sides of the terminal receiving holes to allow insertion of terminals into the terminal receiving holes when the retainer is at the preset position and which project into the terminal receiving holes to engage with the terminals so as to hold the terminals in a come-off preventing state when the retainer is at the set position. The retainer and the seal member are provided at positions which overlap each other in a direction of fitting to the mating connector.

12 Claims, 16 Drawing Sheets

WATERPROOF CONNECTOR THAT CAN BE DESIGNED TO BE SHORT IN OVERALL LENGTH

This application is based upon and claims the benefit of priority from Japanese patent application No. 2010-048809, filed on Mar. 5, 2010, the disclosure of which is incorporated herein in its entirely by reference.

TECHNICAL FIELD

This invention relates to a waterproof connector and, in particular, relates to a waterproof connector that locks terminals using a retainer which is movable in a direction crossing terminal receiving holes.

BACKGROUND ART

JP-A-2000-173709 (Patent Document 1) discloses a waterproof connector of this type. The disclosed waterproof connector will be briefly described with reference to FIG. 1. A seal ring 3 is fitted over an outer periphery of a housing body 1 at a rear end of a hood portion 2 which is provided around the housing body 1 on its front end 1*a* side. A retainer insertion groove 4 is formed in a side surface of the housing body 1 in front of the fitting position of the seal ring 3. A retainer 5 is inserted into the retainer insertion groove 4 through a window hole (not illustrated) which is opened in a side surface of the hood portion 2 at a position corresponding to the retainer insertion groove 4. The retainer 5 is held at a temporary locking position where the retainer 5 allows insertion and removal of terminal metal fittings 6A and 6B and at a real locking position where the retainer 5 locks into recessed portions 7 of the terminal metal fittings 6A and 6B, respectively. Operation of the retainer 5 is carried out from the front side of the housing body 1.

SUMMARY OF THE INVENTION

In the waterproof connector disclosed in Patent Document 1, the retainer insertion position is located forward of a sealing surface provided by the seal ring 3. That is, the retainer insertion groove 4 is located forward of the seal ring 3 and, further, the window hole is formed corresponding to the retainer insertion groove 4. With such a structure in which the retainer insertion position and the sealing surface are offset in the front-rear direction, i.e. in a direction of fitting to a mating connector, it is not possible to avoid an increase in overall length of the waterproof connector.

It is therefore an exemplary object of this invention to provide a waterproof connector that solves the above-mentioned problem.

Other objects of the present invention will become clear as the description proceeds.

According to an aspect of the present invention, there is provided a waterproof connector comprising a housing including a fitting portion which is adapted to be fitted into a fitting hole of a mating connector in a fitting direction, the fitting portion having a terminal receiving hole which penetrates the fitting portion in the fitting direction, a terminal to be received in the terminal receiving hole, a retainer which is assembled in the fitting portion so as to be movable between a preset position and a set position in a direction crossing the terminal receiving hole, and a seal member which is attached to an outer periphery of the fitting portion and is adapted to be brought into close contact with an inner periphery of the fitting hole for sealing when the fitting portion is fitted to the fitting hole, wherein the retainer has a projection which retreats to a side of the terminal receiving hole to allow insertion of the terminal into the terminal receiving hole when the retainer is at the preset position and which projects into the terminal receiving hole to engage with the terminal so as to hold the terminal in the terminal receiving hole when the retainer is at the set position, and the retainer and the seal member are provided at positions which overlap each other in the fitting direction.

DESCRIPTION OF THE EMBODIMENTS

With reference to the drawings, description will be made as regards a waterproof connector according to an exemplary embodiment of this invention.

Figure 1:
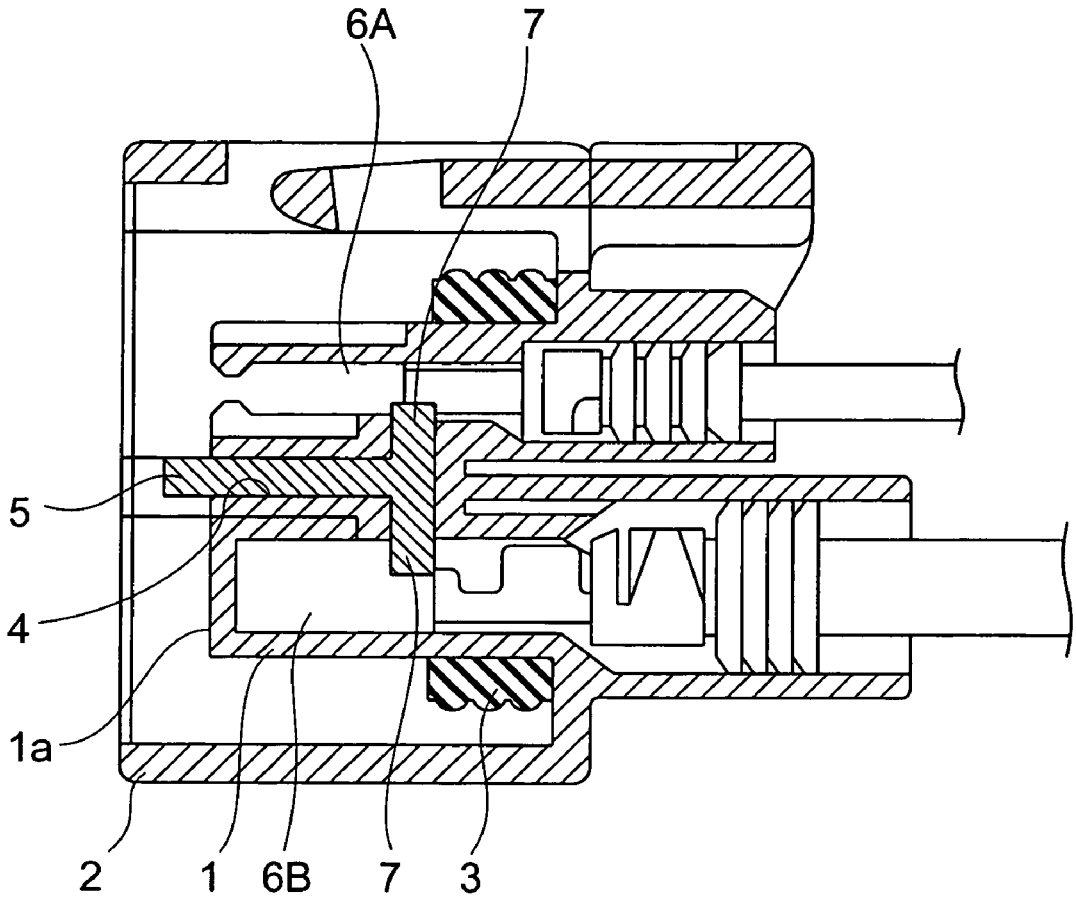
FIG. 1 PRIOR ART
FIG. 1 is a cross-sectional view for explaining a waterproof connector disclosed in Patent Document 1 (JP-A-2000-173709)
Figure 2:
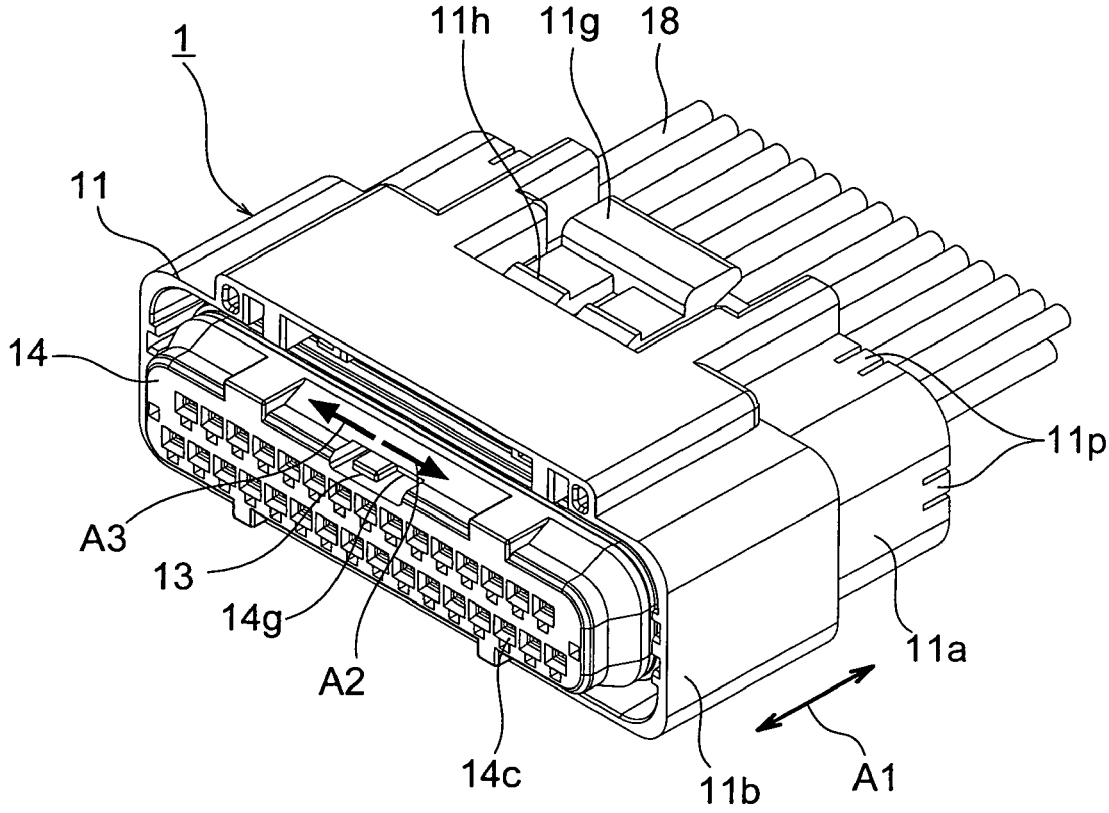
FIG. 2 is an overall perspective view showing a waterproof connector according to an embodiment of this invention in a cable connected state.
Figure 3:
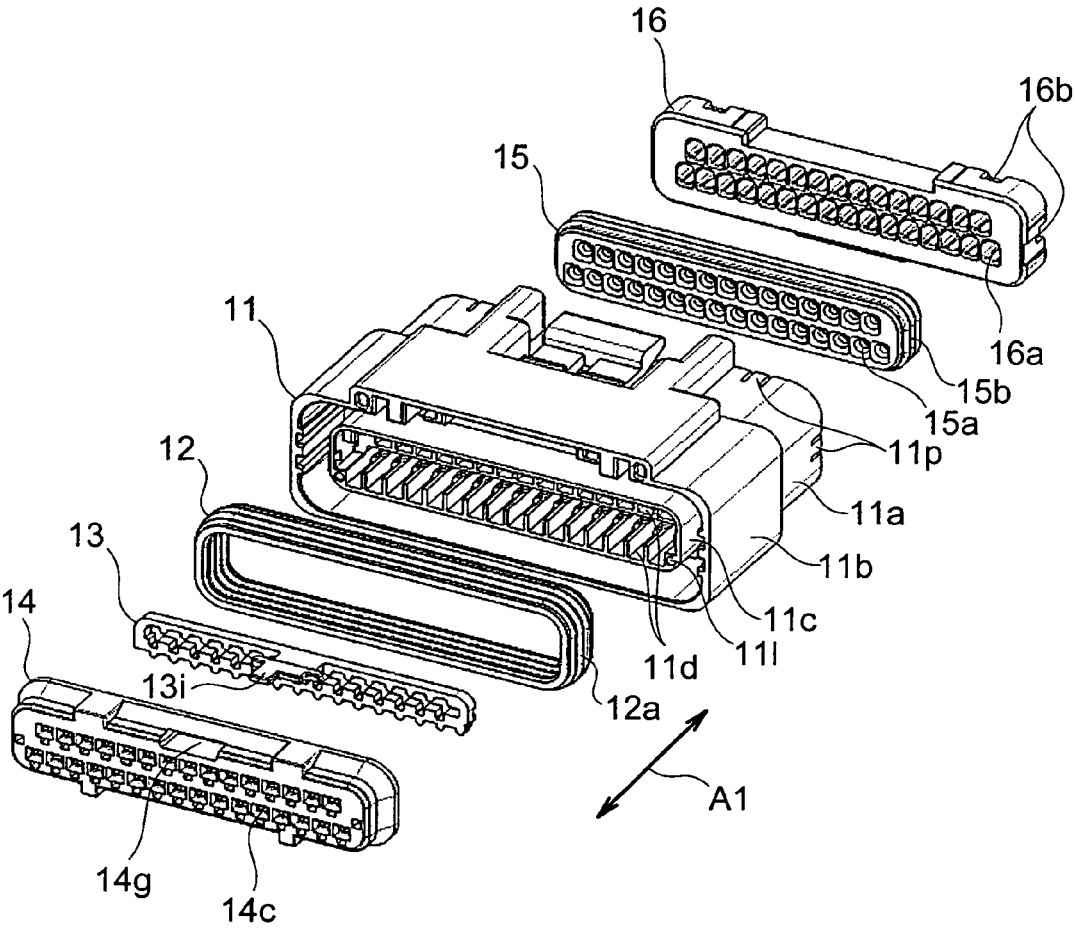
FIG. 3 is an exploded perspective view showing the waterproof connector of FIG. 2 with terminals removed.
Figure 15:
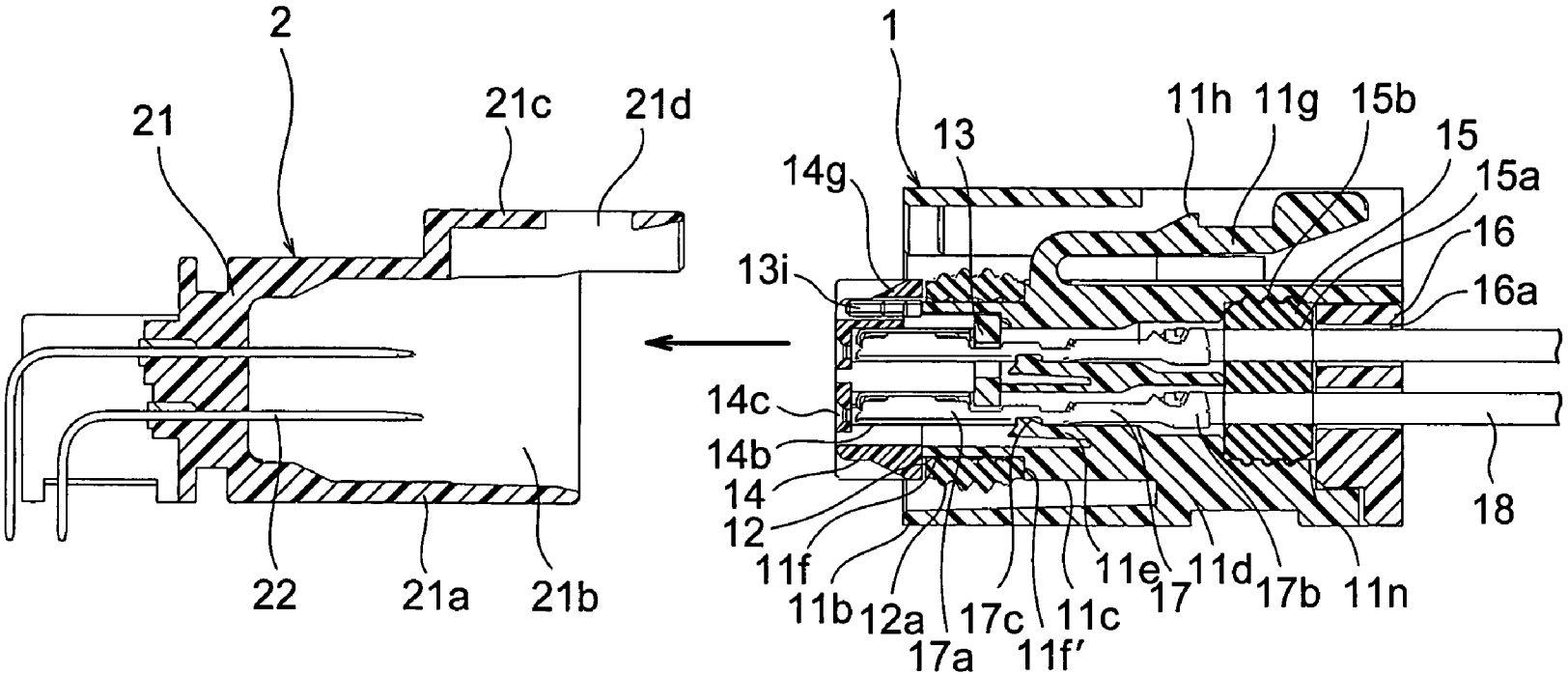
FIG. 15 is a longitudinal cross-sectional view of a state before fitting of the waterproof connector of FIG. 2 to a mating connector, wherein the retainer is at the set position.

Referring to FIGS. 2, 3, and 15, the waterproof connector is generally designated by numeral 1 and comprises a housing 11, a seal member 12, a retainer 13, a front cap 14, a cable seal member 15, a rear cover 16, and a plurality of terminals 17. The housing 11, the retainer 13, the front cap 14, and the rear cover 16 are made of synthetic resin, the seal member 12 and the cable seal member 15 are made of rubber, and the terminals 17 are made of metal.

The housing 11 has a connector body 11*a* of a laterally long rectangular parallelepiped shape in which terminal receiving holes 11*d* each penetrating in a front-rear direction A1 are arranged side by side in two, upper and lower, rows and further has a hood portion 11*b* formed so as to surround the connector body 11*a* on its front end side. The front end side portion, surrounded by the hood portion 11*b*, of the connector body 11*a* forms a fitting portion 11*c* which is adapted to be fitted to a mating connector 2. The connector body 11*a* has a rear end face formed with a cable seal member mounting recess 11*n*. The cable seal member mounting recess 11*n* is formed over the entirety of the rear end face except at its peripheral portion and the terminal receiving holes 11*d* are opened at the bottom of the cable seal member mounting recess 11*n*.

A stepped-down mounting portion 11*f* is formed on an outer periphery of the fitting portion 11*c* on its front end side and the annular seal member 12 is tightly mounted around the seal member mounting portion 11*f*. Further, a locking arm 11*g* is formed so as to extend rearward from an upper surface of the fitting portion 11*c*. An upper wall portion of the hood portion 11*b* is bulged upward so as to surround the locking arm 11*g*.

Figure 4A:
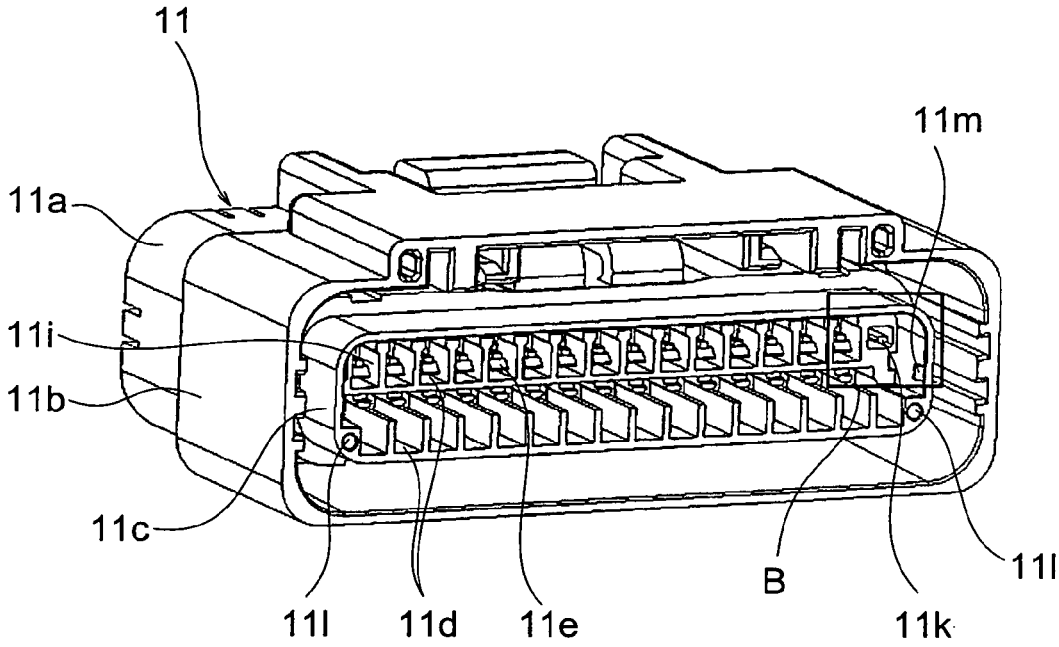
FIG. 4A is a perspective view, as seen from the left, of a housing of the waterproof connector of FIG. 2.
Figure 4B:
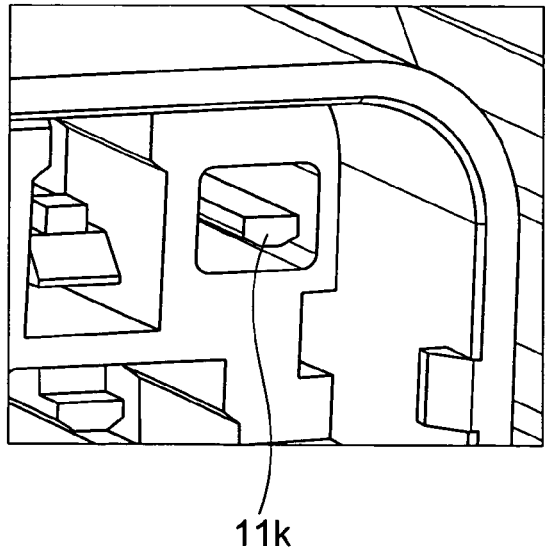
FIG. 4B is an enlarged view of a portion B in FIG. 4A.

Referring further to FIGS. 4A and 4B, a retainer mounting recess portion 11*i* for mounting the retainer 13 is formed at an upper half of a front end face of the fitting portion 11*c* except at its peripheral portion. The upper-row terminal receiving holes 11*d* are opened at the bottom of the retainer mounting recess portion 11*i*. The lower-row terminal receiving holes 11*d* extend to the front end face of the fitting portion 11*c* while their top portions are opened at an inner periphery of the retainer mounting recess portion 11*i*.

As shown in FIGS. 6 and 10A to 14C, the retainer 13 is mounted in the retainer mounting recess portion 11*i* so as to be laterally movable between a preset position which is offset to the right in front view and a set position which is offset to the left in front view. In FIG. 2, A2 represents a direction in which the retainer 13 is moved toward the preset position while A3 represents a direction in which the retainer 13 is moved toward the set position.

Figure 5:
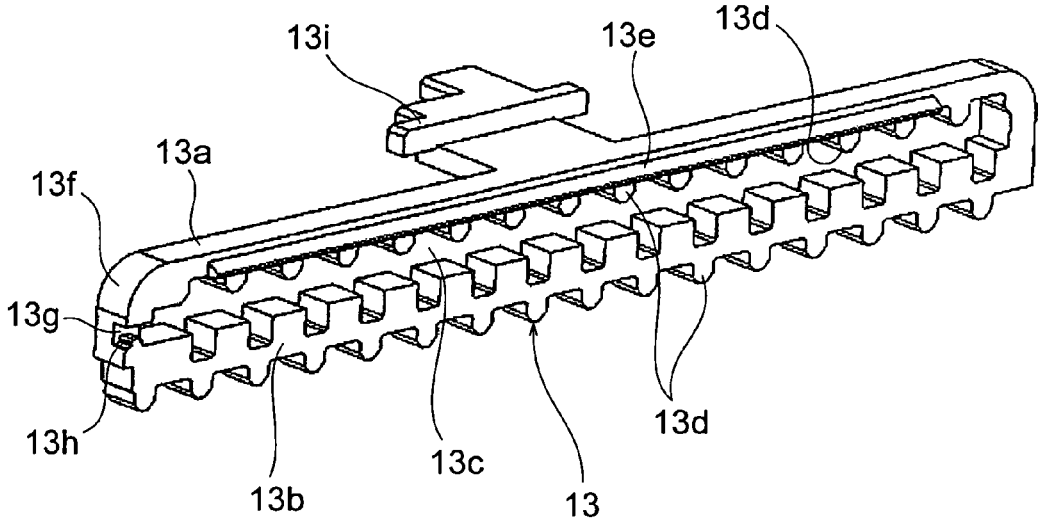
FIG. 5 is a perspective view, as seen from the rear, of a retainer included in the waterproof connector of FIG. 2.
Figure 7A:
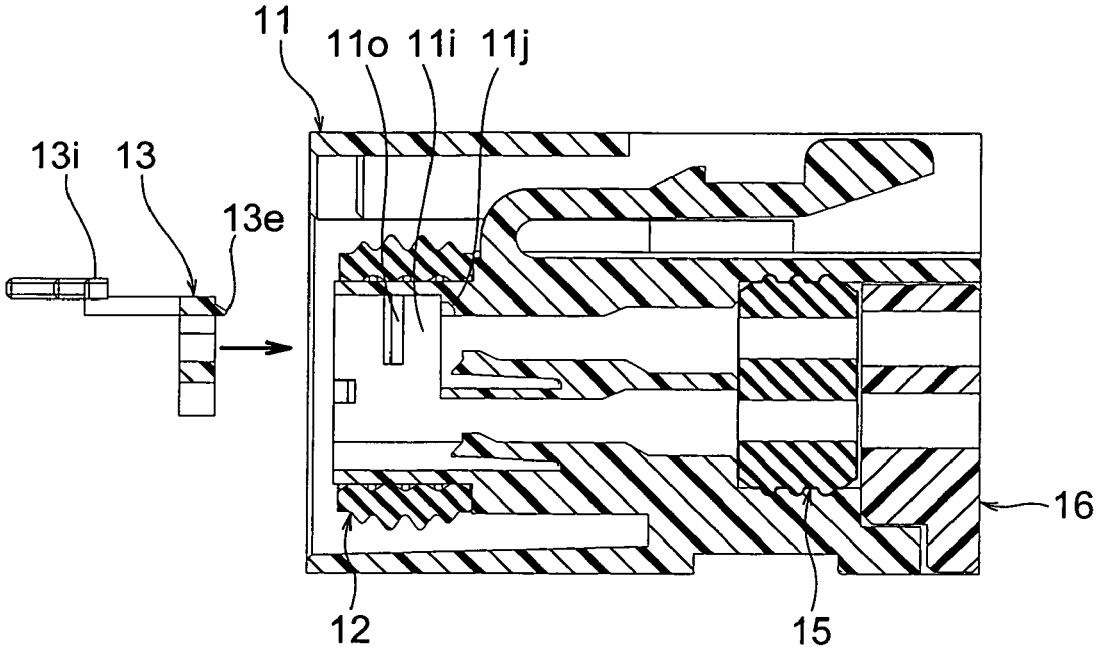
FIG. 7A is a longitudinal cross-sectional view of a state before the retainer is incorporated into the housing, for explaining the incorporation of the retainer into the housing.
Figure 7B:
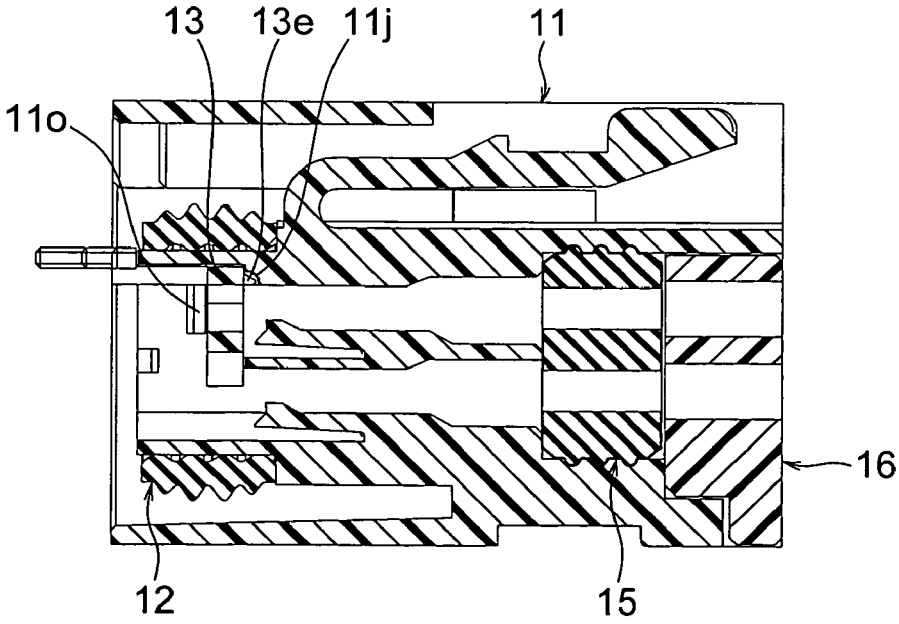
FIG. 7B is a longitudinal cross-sectional view of a state after the retainer is incorporated into the housing, for explaining the incorporation of the retainer into the housing, wherein the retainer is at a preset position.

Referring further to FIGS. 5 and 7A-7B, the retainer 13 has a laterally long frame shape and is mounted in the retainer mounting recess portion 11*i* so that an upper frame portion 13*a* is located above the upper-row terminal receiving holes 11*d*, that a lower frame portion 13*b* is located between the upper-row terminal receiving holes 11*d* and the lower-row terminal receiving holes 11*d*, that a space 13*c* between the upper frame portion 13*a* and the lower frame portion 13*b* faces the upper-row terminal receiving holes 11*d*, and that a laterally long guide protrusion 13*e* formed on a rear face of the upper frame portion 13*a* is inserted into a laterally long guide groove 11*j* formed in the bottom surface of the retainer mounting recess portion 11*i*, thereby laterally guiding the retainer 13 between the preset position and the set position while the guide protrusion 13*e* is received in the guide groove 11*j*.

Further, at the lower edges of the upper and lower frame portions 13*a* and 13*b* of the retainer 13, projections 13*d* are formed at the same pitches as those of the upper- and lower-row terminal receiving holes 11*d*, respectively. As best shown in FIGS. 6 and 10A to 14C, the projections 13*d* retreat to the sides of the terminal receiving holes 11*d*, respectively, when the retainer 13 is at the preset position while the projections 13*d* project into the terminal receiving holes 11*d*, respectively, when the retainer 13 is moved to the set position.

In the middle of the upper frame portion 13*a* of the retainer 13, an operating portion 13*i* for the operation of laterally moving the retainer 13 is formed so as to project forward.

As shown in FIGS. 4A to 5 and 12A to 14C, a positioning mechanism for positioning and holding the retainer 13 selectively at the preset position and at the set position is provided between the retainer 13 and the retainer mounting recess portion 11*i*. Specifically, a locking arm 11*k* which is vertically flexible is protruded at the bottom of the retainer mounting recess portion 11*i* on its right end side while a laterally long escape groove 13*g* where the locking arm 11*k* enters is formed in a rear face of a right frame portion 13*f* of the retainer 13 and a locking dowel 13*h* is formed in the escape groove 13*g* at its lower surface. With this structure, when the locking dowel 13*h* is moved, due to lateral movement of the retainer 13, selectively to the right and to the left of the locking arm 11*k* while bending the locking arm 11*k* upward, so as to engage with the locking arm 11*k*, the retainer 13 is positioned and held selectively at the preset position and at the set position.

Figure 6:
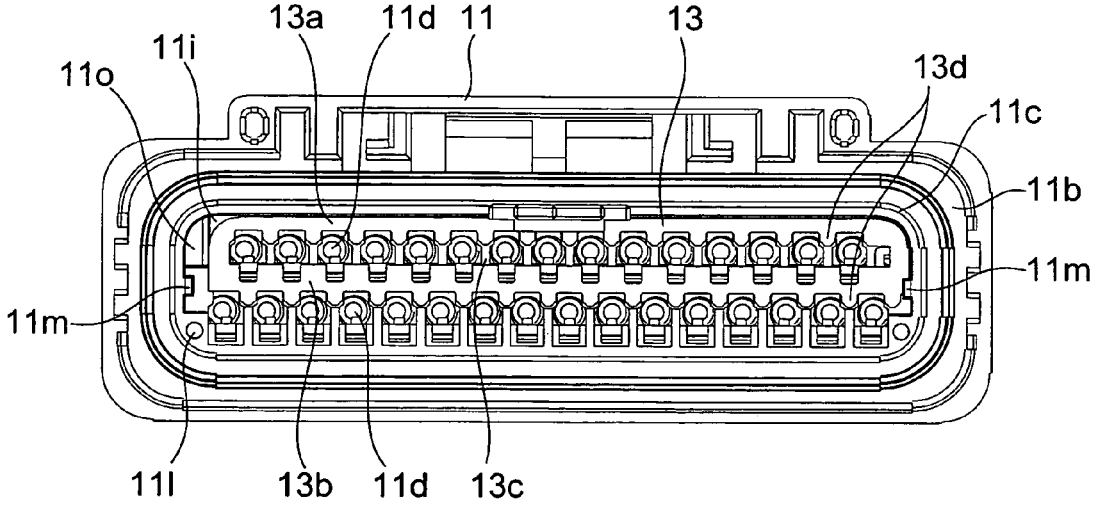
FIG. 6 is a front view of a state where the retainer is incorporated in the housing.

As shown in FIGS. 6 to 7B, a left side wall of the retainer mounting recess portion 11*i* is provided at its inner surface with a guide projection 110 which is brought into contact with a left end of the retainer 13 so as to guide the retainer 13 to the preset position when incorporating the retainer 13 into the retainer mounting recess portion 11*i*. When moving the retainer 13 to the set position, the left end of the retainer 13 enters a space between the bottom of the retainer mounting recess portion 11*i* and the guide projection 110 as shown in FIG. 7B so that the guide projection 110 does not impede lateral movement of the retainer 13.

Figure 8A:
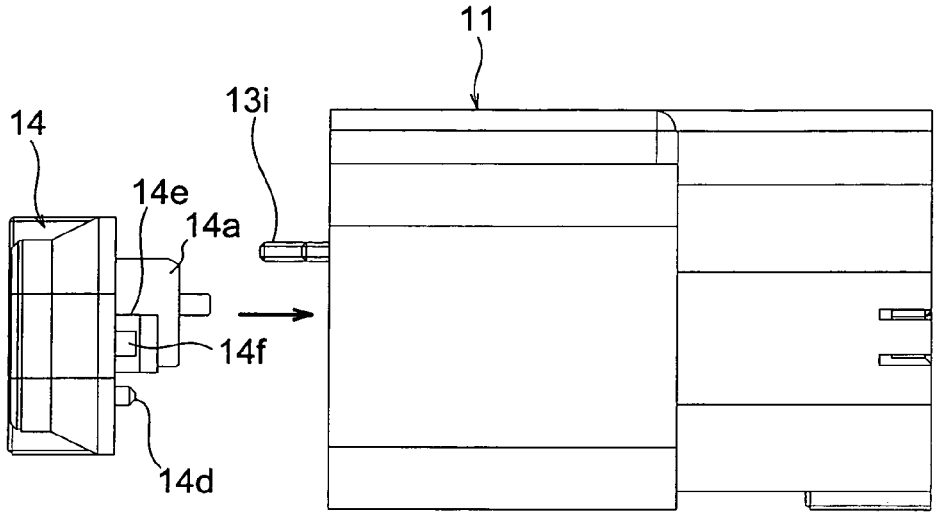
FIG. 8A is a side view of a state before a front cap is incorporated into the housing, for explaining the incorporation of the front cap into the housing, wherein the retainer is at the preset position.
Figure 8B:
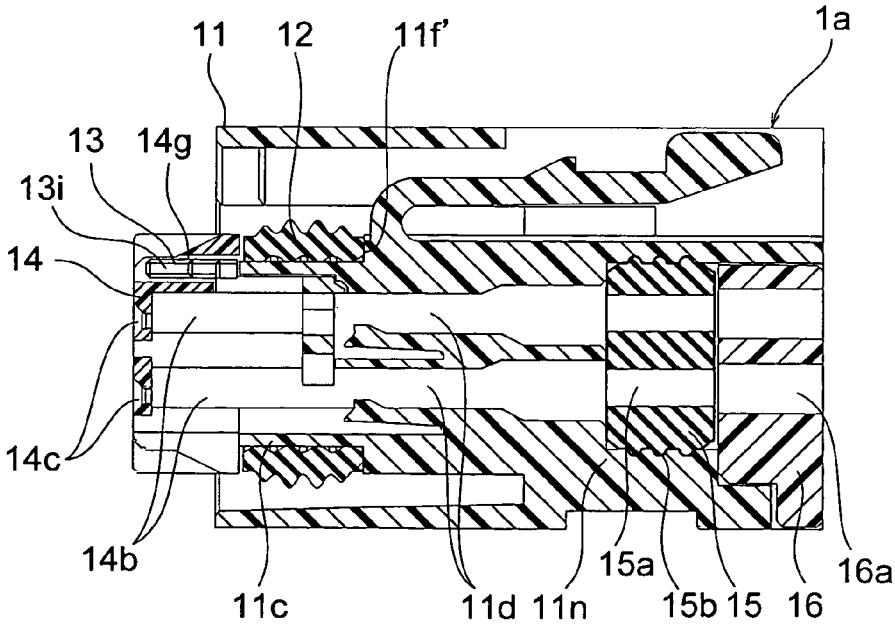
FIG. 8B is a longitudinal cross-sectional view of a state after the front cap is incorporated into the housing, for explaining the incorporation of the front cap into the housing, wherein the retainer is at the preset position.
Figure 10A:
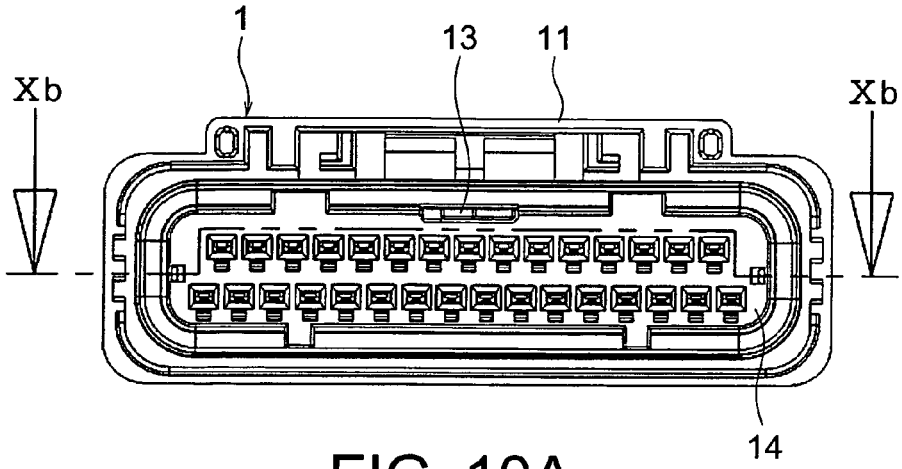
FIG. 10A is a front view of a state where the retainer of the waterproof connector of FIG. 2 is at the preset position.
Figure 10B:
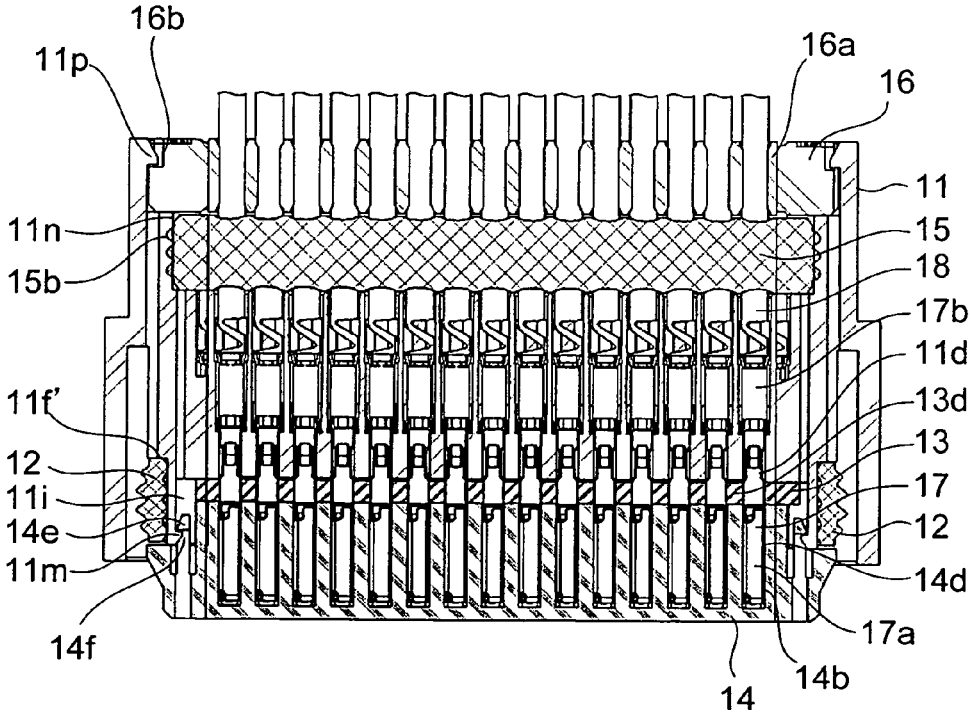
FIG. 10B is a cross-sectional view taken along line Xb-Xb in FIG. 10A.
Figure 11A:
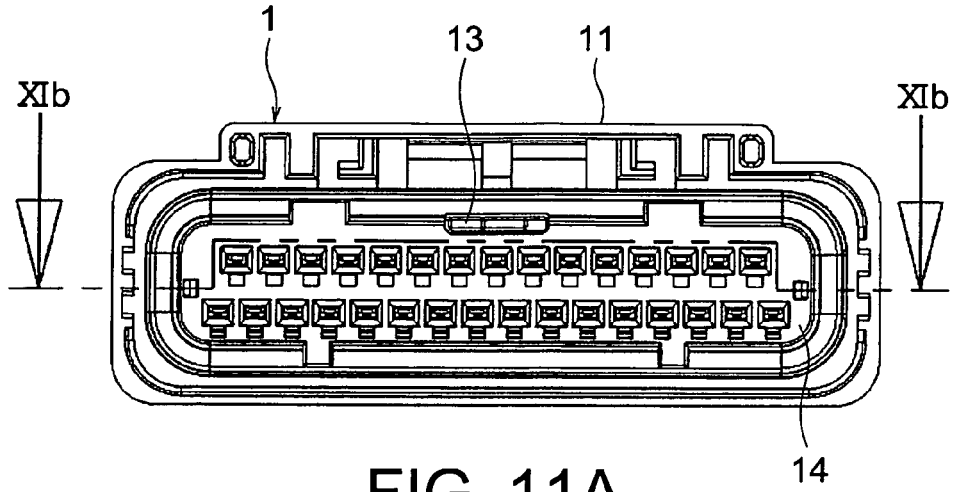
FIG. 11A is a front view of a state where the retainer of the waterproof connector of FIG. 2 is at a set position.
Figure 11B:
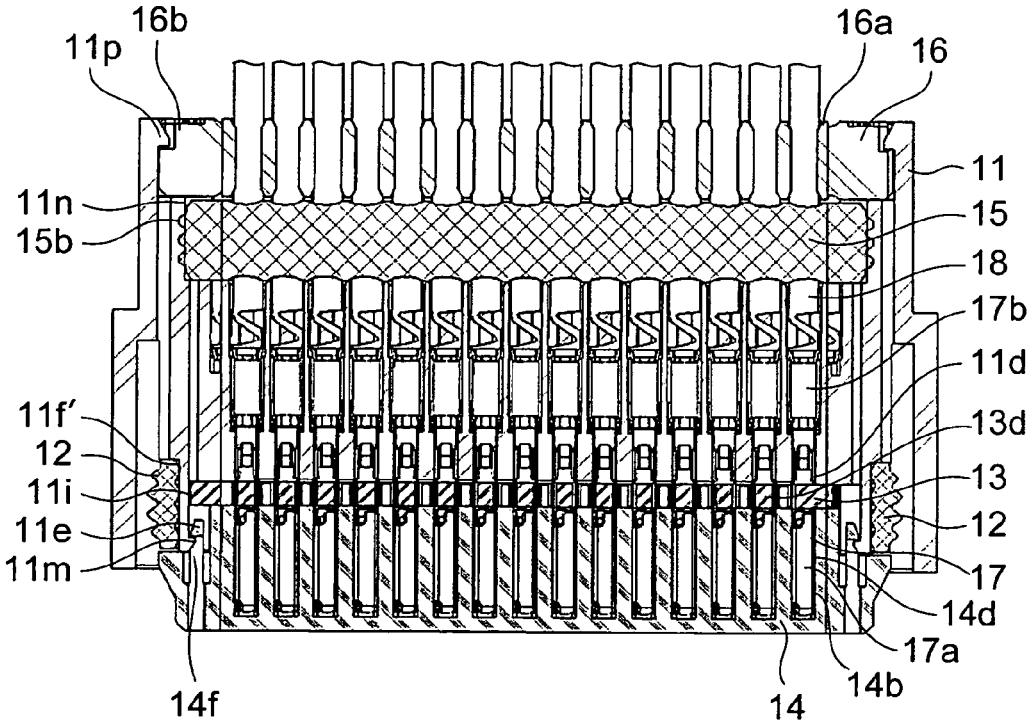
FIG. 11B is a cross-sectional view taken along line XIb-XIb in FIG. 11A.
Figure 12A:
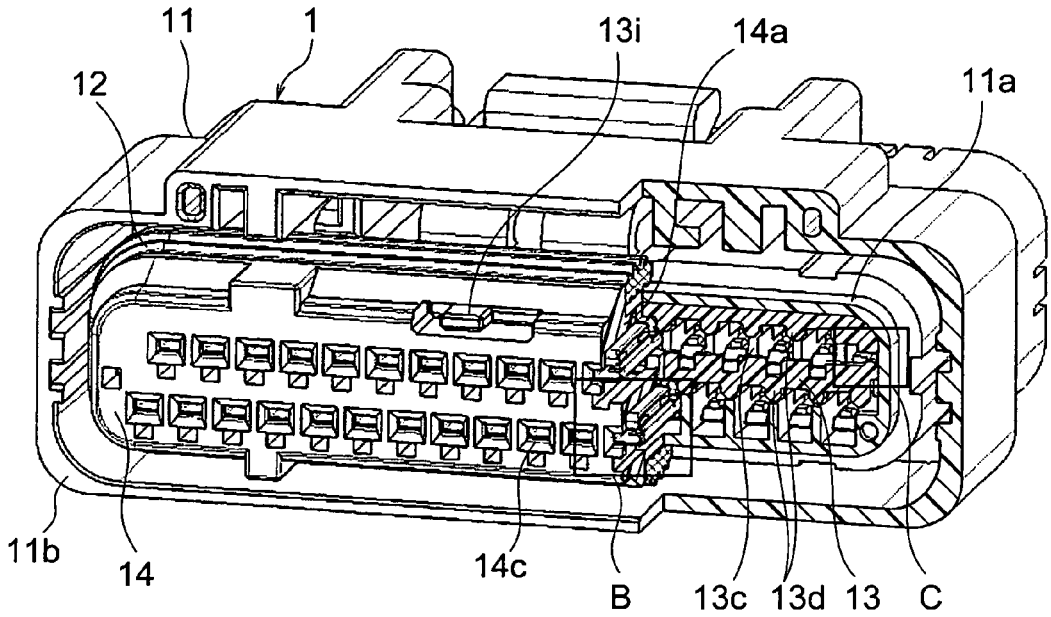
FIG. 12A is a partly sectioned perspective view of a state where the retainer of the waterproof connector of FIG. 2 is at the preset position.
Figure 12B:
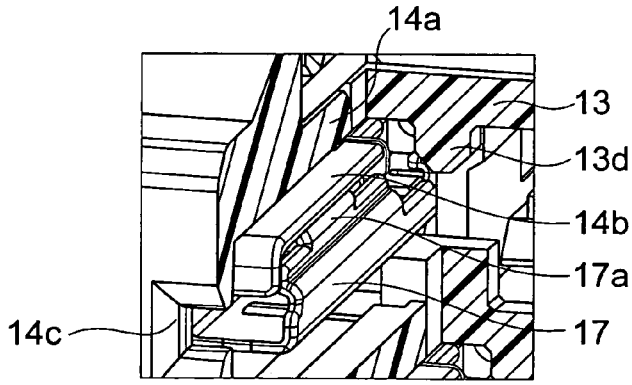
FIG. 12B is an enlarged view of a portion B in FIG. 12A.
Figure 12C:
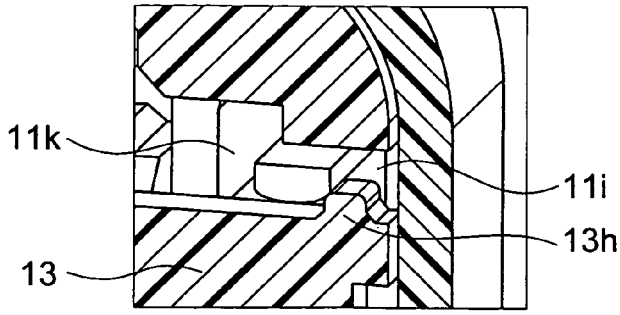
FIG. 12C is an enlarged view of a portion C in FIG. 12A.
Figure 13A:
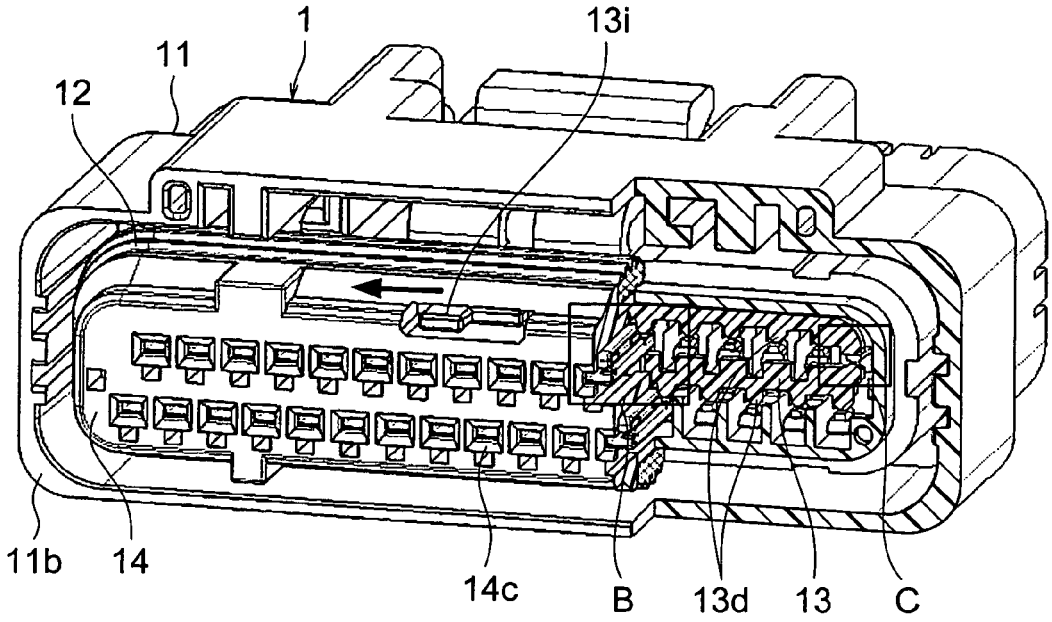
FIG. 13A is a partly sectioned perspective view of a state where the retainer of the waterproof connector of FIG. 2 is on the way from the preset position to the set position.
Figure 13B:
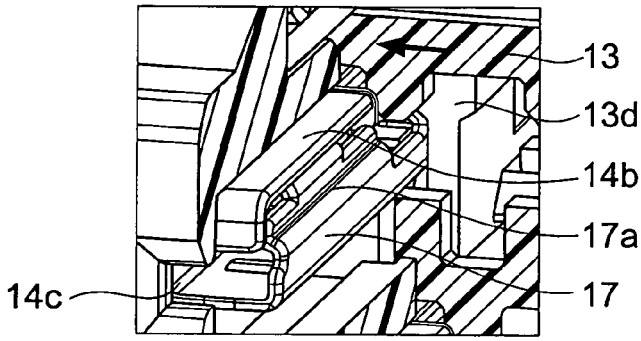
FIG. 13B is an enlarged view of a portion B in FIG. 13A.
Figure 13C:
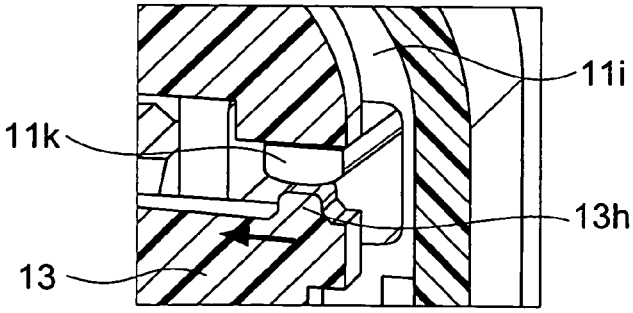
FIG. 13C is an enlarged view of a portion C in FIG. 13A.
Figure 14A:
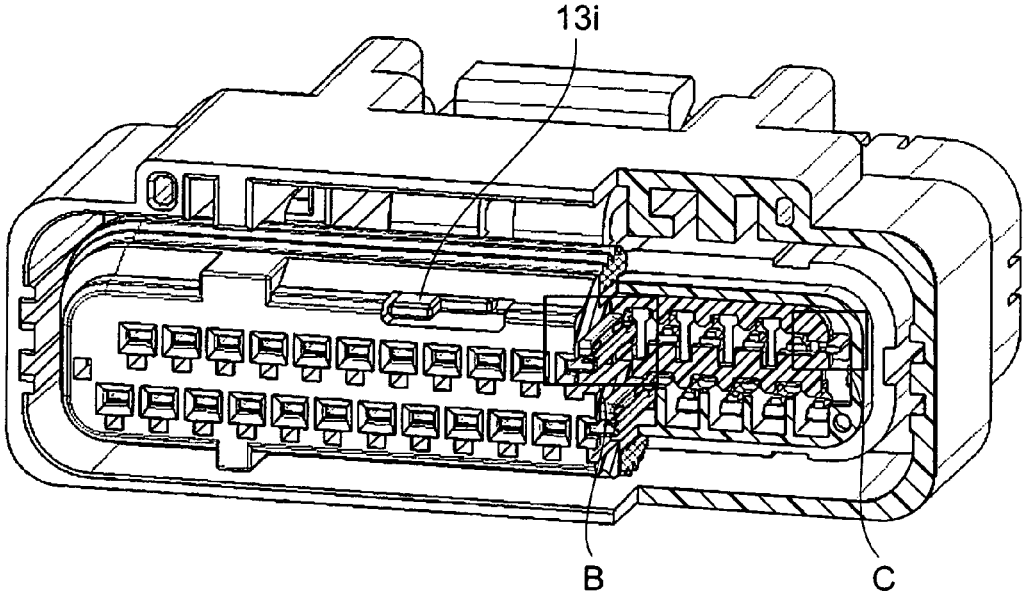
FIG. 14A is a partly sectioned perspective view of a state after the retainer of the waterproof connector of FIG. 2 is moved to the set position.
Figure 14B:
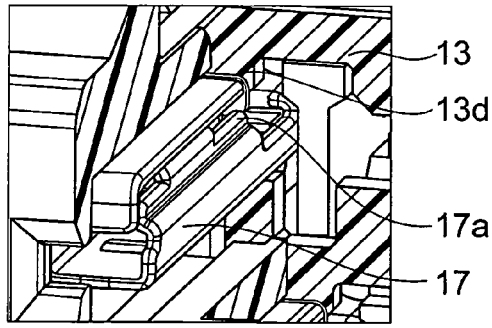
FIG. 14B is an enlarged view of a portion B in FIG. 14A.
Figure 14C:
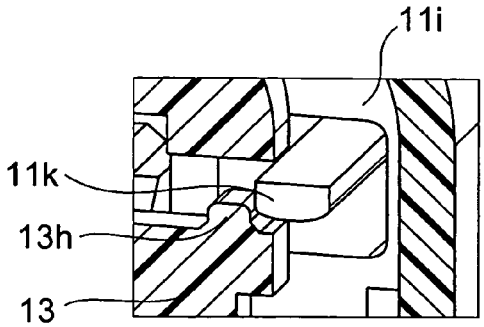
FIG. 14C is an enlarged view of a portion C in FIG. 14A.

As shown in FIG. 8B, the front cap 14 for holding the retainer 13 is fixedly attached to the fitting portion 11*c* at its front end face. The front cap 14 has a rectangular plate-like shape with an outer shape substantially the same as that of the fitting portion 11*c*. The front cap 14 is fixed to the front end face of the fitting portion 11*c* by press-fitting positioning projections 14*d* (see FIG. 8A) provided at lower corners on both sides of a rear face of the front cap 14 into positioning holes 11*l*(see FIG. 6) provided at lower corners on both sides of the front end face of the fitting portion 11*c* and further, as shown in FIG. 10B, by engaging locking holes 14*f* of ]-shaped locking pieces 14*e* (see also FIG. 8A) projecting at both ends of the rear face of the front cap 14 with locking projections 11*m* (see also FIGS. 4A and 6) provided at both side inner surfaces of the retainer mounting recess portion 11*i*. By fixing the front cap 14 in this manner, the seal member 12 is held so as to be sandwiched between a rear face peripheral edge portion of the front cap 14 and a rear stepped face 11*f'* of the seal member mounting portion 11*f*.

As shown in FIGS. 8A and 12A to 12C, the front cap 14 has, at its rear face, a laterally long block-like projecting portion 14*a* which is received in the retainer mounting recess portion 11*i* so that the retainer 13 is held so as to be sandwiched between the projecting portion 14*a* and the bottom of the retainer mounting recess portion 11*i*. As shown in FIGS. 2 and 8B, a front end of the operating portion 13*i* of the retainer 13 is exposed at a front face of the front cap 14 through a retainer operating portion insertion hole 14*g*, thereby allowing the operation for lateral movement of the retainer 13.

As shown in FIGS. 8B and 12A to 12C, the rear face of the front cap 14 and a rear face of the projecting portion 14*a* are formed with additional terminal receiving holes 14*b* which communicate with the upper- and lower-row terminal receiving holes 11*d* of the fitting portion 11*c*, respectively, and front end portions of the terminal receiving holes 14*b* are opened at the front face of the front cap 14 so as to serve as mating terminal insertion holes 14*c*. An outer peripheral surface of the front cap 14 is formed as a tapered surface for facilitating fitting to the mating connector 2.

As shown in FIGS. 8B and 10B, the cable seal member 15 and the rear cover 16 are fixedly mounted in the cable seal member mounting recess 11*n* at the rear end face of the connector body 11*a*. As shown in FIG. 3, the cable seal member 15 has a rectangular plate-like shape and is formed with cable insertion holes 15*a* which communicate with the terminal receiving holes 11*d*, respectively, and further formed on its outer periphery with sealing protrusions 15*b* which are in tight or close contact with an inner periphery of the cable seal member mounting recess 11*n* for sealing. As shown in FIG. 3, the rear cover 16 has a rectangular plate-like shape and is formed with cable insertion holes 16*a* which communicate with the cable insertion holes 15*a* of the cable seal member 15, respectively. As shown in FIGS. 8B and 10B, the rear cover 16 is mounted in the cable seal member mounting recess 11*n* so as to be in abutment with the cable seal member 15 and is fixed by engaging locking claws 11*p* (see also FIG. 3) provided at a rear end edge of the cable seal member mounting recess 11*n* with locking recesses 16*b* provided at a rear end edge of the rear cover 16.

Figure 9:
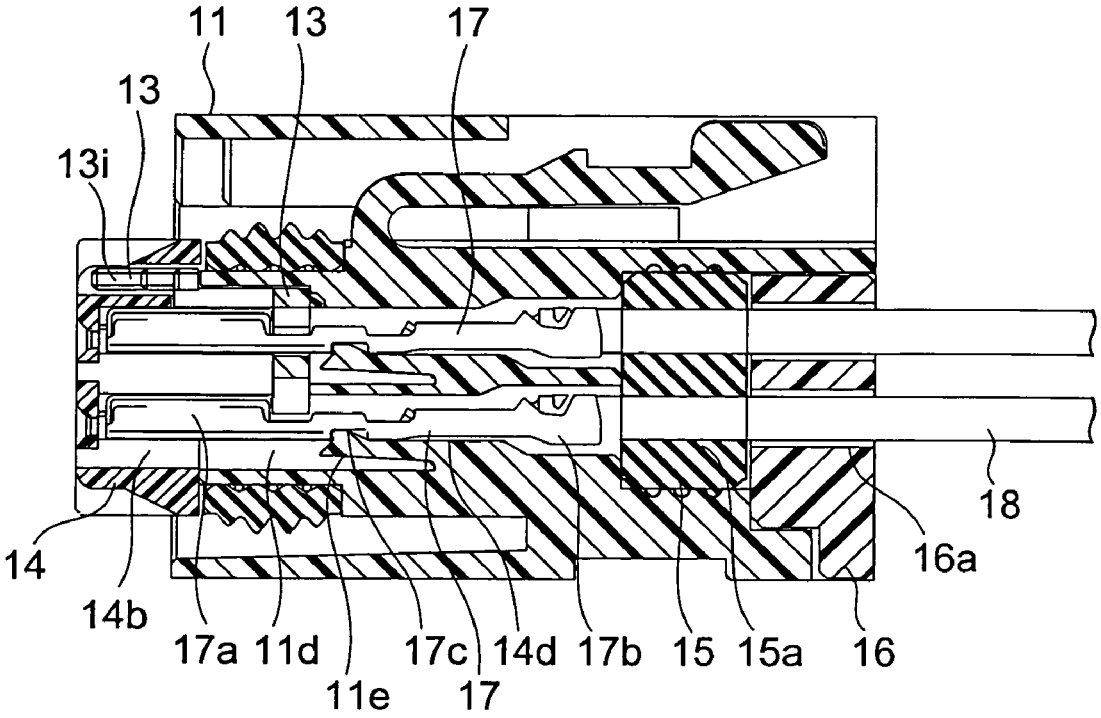
FIG. 9 is a longitudinal cross-sectional view of the waterproof connector of FIG. 2, wherein the retainer is at the preset position.

As shown in FIG. 9, each terminal 17 has a box-shaped contact portion 17*a* at its front end and a cable crimping portion 17*b* at its rear end. After cables 18 are crimped to the cable crimping portions 17*b*, the terminals 17 are inserted into the terminal receiving holes 11*d* and 14*b* of a connector assembly 1*a* (see FIG. 8B) comprising the housing 11, the seal member 12, the retainer 13, the front cap 14, the cable seal member 15, and the rear cover 16 through the cable insertion holes 16*a* and 15*a* in the preset state of the retainer 13.

In this event, as shown in FIGS. 9, 10A-10B, and 12A to 12C, since the retainer 13 is at the preset position and thus the projections 13*d* are at the positions retreated to the sides of the terminal receiving holes 11*d* and 14*b*, the terminals 17 are inserted deeply into the terminal receiving holes 11*d* and 14*b* and, when each terminal 17 abuts against a deep end face being a boundary with the mating terminal insertion hole 14*c*, a lance 11*e* provided on an inner periphery of the terminal receiving hole 11*d* enters a locking hole 17*c* provided at an intermediate portion of the terminal 17 so that the terminal 17 is primarily locked in a come-off preventing state.

Thereafter, the retainer 13 is laterally moved to the set position from the preset position by operating the operating portion 13*i* from the front side of the front cap 14. Then, as shown in FIGS. 11A-11B, 14A to 14C, and 15, the projections 13*d* of the retainer 13 project into the terminal receiving holes 11*d* and 14*b* so that each projection 13*d* engages with a rear end face of the box-shaped contact portion 17*a*, thereby secondarily locking the terminal 17 in a come-off preventing state.

In this manner, the terminals 17 are double locked to the housing 11 and thus are firmly held in the come-off preventing state. Further, in this event, an inner periphery of each cable insertion hole 15*a* of the cable seal member 15 is brought into tight or close contact with an outer periphery of the cable 18 inserted into the cable insertion hole 15*a* and, as described above, the sealing protrusions 15*b* on the outer periphery of the cable seal member 15 are in tight or close contact with the inner periphery of the cable seal member mounting recess 11*n*, thereby sealing between the cables 18 and the housing 11. In this manner, the waterproof connector 1 is completed.

Figure 16:
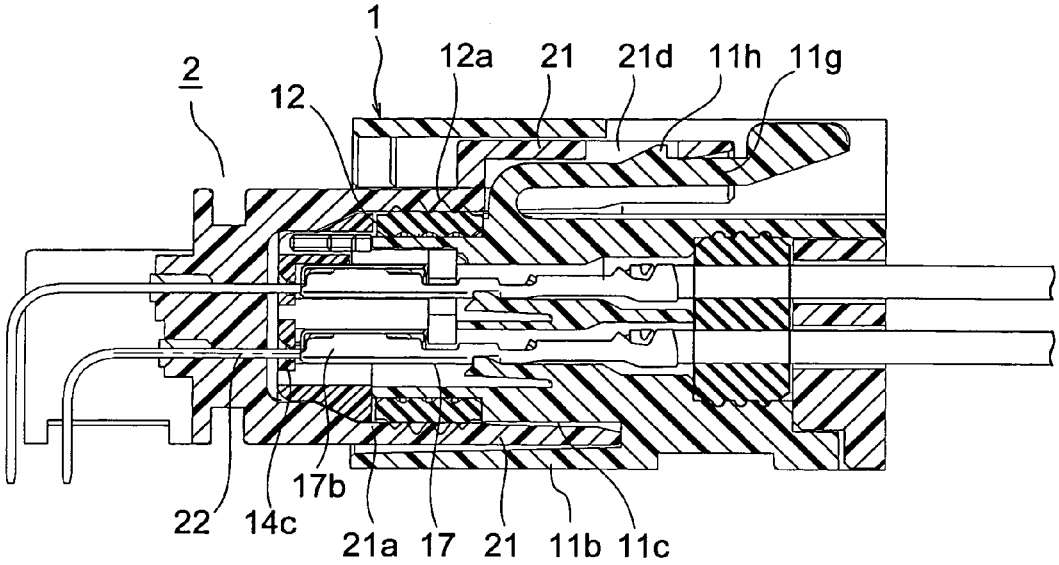
FIG. 16 is a longitudinal cross-sectional view of a state after fitting of the waterproof connector of FIG. 2 to the mating connector, wherein the retainer is at the set position.
Figure 17A:
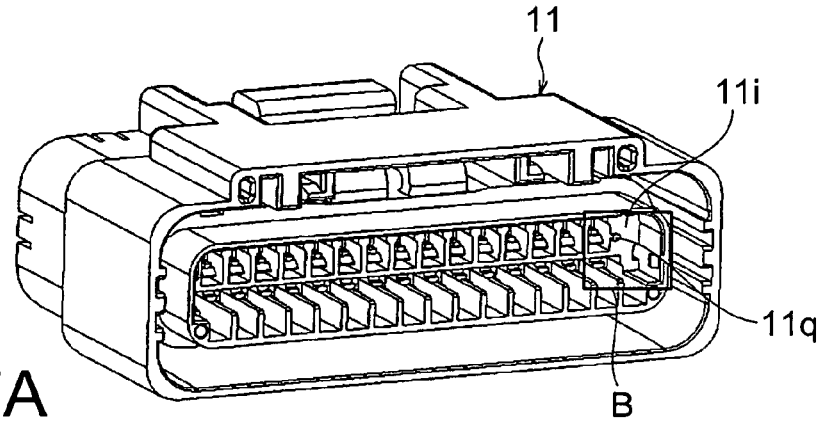
FIG. 17A is a perspective view of a housing for explaining a modification of a retainer positioning mechanism.
Figure 17B:
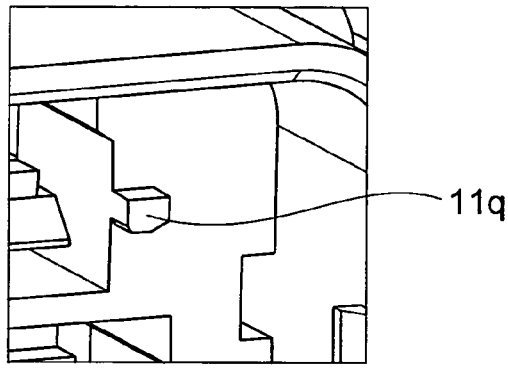
FIG. 17B is an enlarged view of a portion B in FIG. 17A.
Figure 17C:
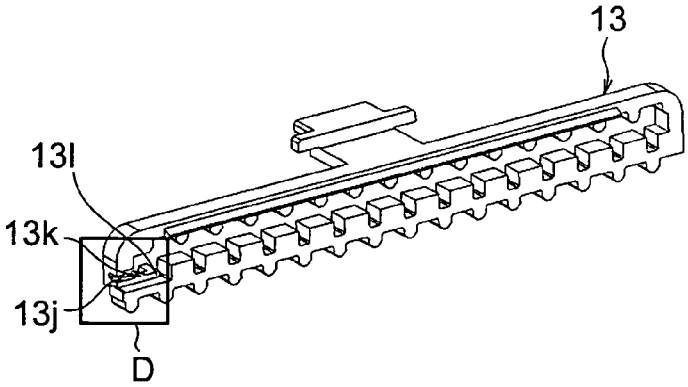
FIG. 17C is a perspective view of a retainer.
Figure 17D:
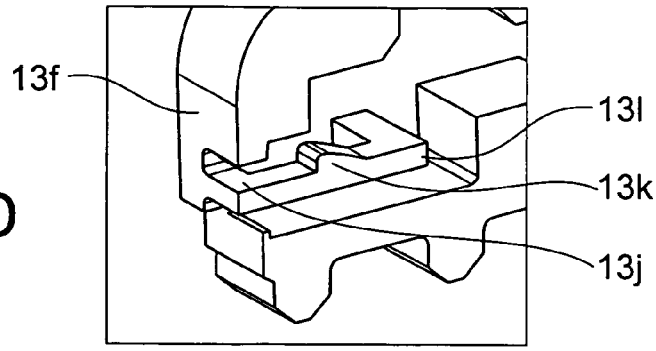
FIG. 17D is an enlarged view of a portion D in FIG. 17C.

FIG. 15 is a longitudinal cross-sectional view showing a state before fitting of the waterproof connector 1 to the mating connector 2 and FIG. 16 is a longitudinal cross-sectional view showing a state after the fitting.

Referring to FIGS. 15 and 16, the mating connector 2 comprises a housing 21 of a bottomed hollow rectangular parallelepiped shape having a fitting tubular portion 21*a* with a fitting hole 21*b* which is opened forward, and a plurality of pin terminals 22 which pass through and are held by the bottom of the fitting hole 21*b*, wherein the fitting tubular portion 21*a* is provided, at its upper wall portion on the front end side, with a locking piece 21*c* which is bulged upward and projects forward.

When the fitting tubular portion 21*a* of the mating connector 2 is inserted into a space between the fitting portion 11*c* and the hood portion 11*b* of the waterproof connector 1, the fitting portion 11*c* of the waterproof connector 1 enters the fitting hole 21*b* of the mating connector 2 so that the pin terminals 22 enter the box-shaped contact portions 17*a* of the terminals 17 in the fitting portion 11*c* through the mating terminal insertion holes 14*c* so as to be in contact with the terminals 17, thereby electrically connecting the waterproof connector 1 and the mating connector 2 to each other. Further, sealing protrusions 12*a* of the seal member 12 disposed on the outer periphery of the fitting portion 11*c* are brought into tight or close contact with an inner periphery of the fitting tubular portion 21*a*, thereby achieving waterproofing between the waterproof connector 1 and the mating connector 2. Further, a locking hole 21*d* provided in the locking piece 21*c* of the mating connector 2 engages with a locking projection 11*h* of the locking arm 11*g* of the waterproof connector 1, thereby locking the fitting state of the connectors 1 and 2.

FIGS. 17A to 17D show a modification of the positioning mechanism for positioning and holding the retainer 13 selectively at the preset position and at the set position.

In this modification, a locking dowel 11*q* is formed at the bottom of a retainer mounting recess portion 11*i* on its right end side while a laterally long groove space 13*j* where the locking dowel 11*q* enters is formed in a rear face of a right frame portion 13*f* of a retainer 13 and a locking arm 13l extending laterally, being vertically flexible, and having a locking projection 13*k* at its upper surface is formed in the groove space 13*j*. With this structure, when the locking projection 13*k* is moved, due to lateral movement of the retainer 13, selectively to the right and to the left of the locking dowel 11*q* while bending the locking arm 13*l* downward, so as to engage with the locking dowel 11*q*, the retainer 13 is positioned and held selectively at the preset position and at the set position.

According to the waterproof connector 1 described above, since the outer periphery of the fitting portion 11*c* has no opening for inserting the retainer 13, the retainer 13 and the seal member 12 can be disposed at positions overlapping each other in the front-rear direction A1 and therefore the overall length of the waterproof connector 1 can be made short.

In the conventional waterproof connector, since the outer periphery of the fitting portion has the opening for inserting the retainer, there is no alternative but to mount the seal member on the outer periphery of the fitting portion at the position rearward of the opening so that the overall length of the connector is prolonged correspondingly. In particular, generally, in order to provide a double locking mechanism of terminal holding by a resin lance (primary locking) and terminal holding by a retainer (secondary locking), male and female connectors should each have a retainer insertion opening forward (i.e. on the mating connector side) of a waterproof range which is involved in waterproofing between both housings. Therefore, when a slide-type preset retainer is applied to the conventional waterproof connector, the position of the waterproof surface should be retreated corresponding to the thickness of the retainer and thus the overall length of the connector is prolonged correspondingly.

In contrast, according to the embodiment of this invention, the overall length of the waterproof connector, having the waterproofing seal member disposed on the outer periphery of the fitting portion and having the terminal-locking lateral slide-type retainer incorporated in the fitting portion, can be designed to be short. That is, the retainer is incorporated so as to be operable from the front end face of the fitting portion, no opening is provided for incorporating the retainer from the outer periphery of the fitting portion, and the seal member and the retainer are disposed at the positions overlapping each other in the fitting direction, thereby enabling shortening of the overall length of the connector.

Further, by incorporating the retainer inward of the waterproof surface of the housing and projecting only the portion, for manually performing the slide operation of the retainer, forward (on the mating connector side) of the waterproof range, no retainer incorporation opening is required at the outer periphery of the housing. Therefore, the layout of the positions of the important functions such as the waterproof range and the locking mechanism can be freely carried out.

Various exemplary embodiments of this invention will be enumerated in the following items 1-12.

1. A waterproof connector 1 comprising:

a housing 11 including a fitting portion 11*c* which is adapted to be fitted into a fitting hole 21*b* of a mating connector 2 in a fitting direction, the fitting portion having a terminal receiving hole 11*d* which penetrates the fitting portion in the fitting direction;

a terminal 17 to be received in the terminal receiving hole;

a retainer 13 which is assembled in the fitting portion so as to be movable between a preset position and a set position in a direction crossing the terminal receiving hole; and a seal member 12 which is attached to an outer periphery of the fitting portion and is adapted to be brought into close contact with an inner periphery of the fitting hole for sealing when the fitting portion is fitted to the fitting hole;

wherein the retainer has a projection 13*d* which retreats to a side of the terminal receiving hole to allow insertion of the terminal into the terminal receiving hole when the retainer is at the preset position and which projects into the terminal receiving hole to engage with the terminal so as to hold the terminal in the terminal receiving hole when the retainer is at the set position, and the retainer and the seal member are provided at positions which overlap each other in the fitting direction.

2. The waterproof connector according to item 1, further comprising:

a retainer mounting recess portion 11*i* which is formed in a front end face of the fitting portion; and a front cap 14 which is formed with an additional terminal receiving hole 14*b* communicating with the terminal receiving hole of the fitting portion and is attached to the front end face of the fitting portion, wherein the retainer is received in the retainer mounting recess portion and sandwiched between a bottom of the retainer mounting recess portion and the front cap.

3. The waterproof connector according to item 2, wherein the retainer comprises an operating portion 13*i* which is exposed at a front end face of the front cap through a retainer operating portion insertion hole 14*g* provided in the front cap, thereby allowing operation for lateral movement of the retainer.

4. The waterproof connector according to item 3, further comprising a positioning mechanism for positioning and holding the retainer selectively at the preset position and at the set position.

5. The waterproof connector according to item 4, wherein the positioning mechanism comprises:

a locking dowel 13*h* provided at one of the retainer mounting recess portion and the retainer; and a locking arm 13*l* provided at the other of the retainer mounting recess portion and the retainer, wherein the locking arm is moved to elastically ride over the locking dowel due to lateral movement of the retainer so as to be locked on both sides of the locking dowel, respectively.

6. The waterproof connector according to item 5, further comprising a stepped-down mounting portion 11*f* formed on the outer periphery of the fitting portion at its front end portion, wherein the seal member is mounted on the stepped-down mounting portion and held so as to be sandwiched between a rear stepped face of the seal member mounting portion and a rear face peripheral edge portion of the front cap.

7. The waterproof connector according to item 1, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

8. The waterproof connector according to item 2, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

9. The waterproof connector according to item 3, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

10. The waterproof connector according to item 4, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

11. The waterproof connector according to item 5, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

12. The waterproof connector according to item 6, wherein the terminal has a locking hole 17*c*, the terminal receiving hole has an inner periphery which is provided with a lance 11*e*, the terminal is primarily locked by engagement of the lance into the locking hole caused by insertion of the terminal into the terminal receiving hole, and the terminal is secondarily locked by moving the retainer from the preset position to the set position.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A waterproof connector comprising:

a housing including a fitting portion which is adapted to be fitted into a fitting hole of a mating connector in a fitting direction, the fitting portion having a terminal receiving hole which penetrates the fitting portion in the fitting direction;

a terminal to be received in the terminal receiving hole;

a retainer which is assembled in the fitting direction so as to be movable between a preset position and a set position in a direction crossing the terminal receiving hole; and a seal member which is attached to an outer periphery of the fitting portion and is adapted to be brought into close contact with an inner periphery of the fitting hole for sealing when the fitting portion is fitted to the fitting hole;

wherein the retainer has a projection which retreats to a side of the terminal receiving hole to allow insertion of the terminal into the terminal receiving hole when the retainer is at the preset position and which projects into the terminal receiving hole to engage with the terminal so as to hold the terminal in the terminal receiving hole when the retainer is at the set position, and the retainer and the seal member are provided at positions which overlap each other in the fitting direction.

2. The waterproof connector according to claim 1, further comprising:

a retainer mounting recess portion which is formed in a front end face of the fitting portion; and a front cap which is formed with an additional terminal receiving hole communicating with the terminal receiving hole of the fitting portion and is attached to the front end face of the fitting portion, wherein the retainer is received in the retainer mounting recess portion and sandwiched between a bottom of the retainer mounting recess portion and the front cap.

3. The waterproof connector according to claim 2, wherein the retainer comprises an operating portion which is exposed at a front end face of the front cap through a retainer operating portion insertion hole provided in the front cap, thereby allowing operation for lateral movement of the retainer.

4. The waterproof connector according to claim 3, further comprising a positioning mechanism for positioning and holding the retainer selectively at the preset position and at the set position.

5. The waterproof connector according to claim 4, wherein the positioning mechanism comprises:

a locking dowel provided at one of the retainer mounting recess portion and the retainer; and a locking arm provided at the other of the retainer mounting recess portion and the retainer, wherein the locking arm is moved to elastically ride over the locking dowel due to lateral movement of the retainer so as to be locked on both sides of the locking dowel, respectively.

6. The waterproof connector according to claim 5, further comprising a stepped-down mounting portion formed on the outer periphery of the fitting portion at its front end portion, wherein the seal member is mounted on the stepped-down mounting portion and held so as to be sandwiched between a rear stepped face of the seal member mounting portion and a rear face peripheral edge portion of the front cap.

7. The waterproof connector according to claim 1, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

8. The waterproof connector according to claim 2, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

9. The waterproof connector according to claim 3, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

10. The waterproof connector according to claim 4, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

11. The waterproof connector according to claim 5, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

12. The waterproof connector according to claim 6, wherein the terminal has a locking hole, the terminal receiving hole has an inner periphery which is provided with a lance, the terminal is primarily locked by engagement of the lance into the locking hole caused by insertion of the terminal into the terminal receiving hole, and the terminal is secondarily locked by moving the retainer from the preset position to the set position.

* * * * *